3/28/78 XR 4,081,798

United States Patent [19]

Pelfrey

[11] 4,081,798

[45] Mar. 28, 1978

[54] NET-BALL DETECTORS

[76] Inventor: Lowell Sherman Pelfrey, Berkeley, Calif.

[21] Appl. No.: 782,111

[22] Filed: Mar. 14, 1977

Related U.S. Application Data

[63] Continuation-in-part of Ser. No. 588,137, Feb. 23, 1976, abandoned.

[51] Int. Cl.[2] ..... G08B 23/00; A63B 61/00

[52] U.S. Cl. ..... 340/323 R; 73/658; 273/29 R

[58] Field of Search ..... 340/323 R, 261; 273/29 R, 29 B, 29 BA, 29 BB, 1 M, 1 E, 31; 324/34 R, 34 D, 34 PS; 73/70, 71.5 R, 70.2, 71.2, 71.4

[56] References Cited

U.S. PATENT DOCUMENTS

| | | | |
|---|---|---|---|
| 3,415,517 | 12/1968 | Krist | 340/323 R |
| 3,677,077 | 7/1972 | Merryman et al. | 73/71.2 |
| 3,697,867 | 10/1972 | Klessattel | 73/71.4 |
| 3,774,194 | 11/1973 | Jokay et al. | 340/323 R |
| 3,924,261 | 12/1975 | Kardashian | 73/71.2 |
| 3,982,759 | 9/1976 | Grant | 340/323 R |
| 4,004,805 | 1/1977 | Chen et al. | 340/323 R |

*Primary Examiner*—John W. Caldwell, Sr.
*Assistant Examiner*—James J. Groody

[57] ABSTRACT

Electric currents induced by a magnetic field being moved in relation to a fixed coil, by a vertical displacement of the net cable/tennis net, enables a referee to detect the occurrence of a "let-ball."

4 Claims, 2 Drawing Figures

LET-BALL DETECTORS

This application is a continuation-in-part of Ser. No. 588,137, filed on 2/23/76, now abandoned.

SUMMARY

If a member providing a magnetic field is connected to the net band or cable of a tennis net, and a coil of electrically-conducting wire is attached to a fixed position such as the net post or the ground, and the magnetic field intersects the coil, then, if a ball strikes the top of the net, causing a vertical displacement of the net band or cable, an electric current will be induced in the coil. This current can be used to trigger an electronic circuit, causing an alarm system to be activated, warning the umpire that a let-ball has occurred.

DESCRIPTION OF THE DISCLOSED EMBODIMENTS

Figures 1, 2:
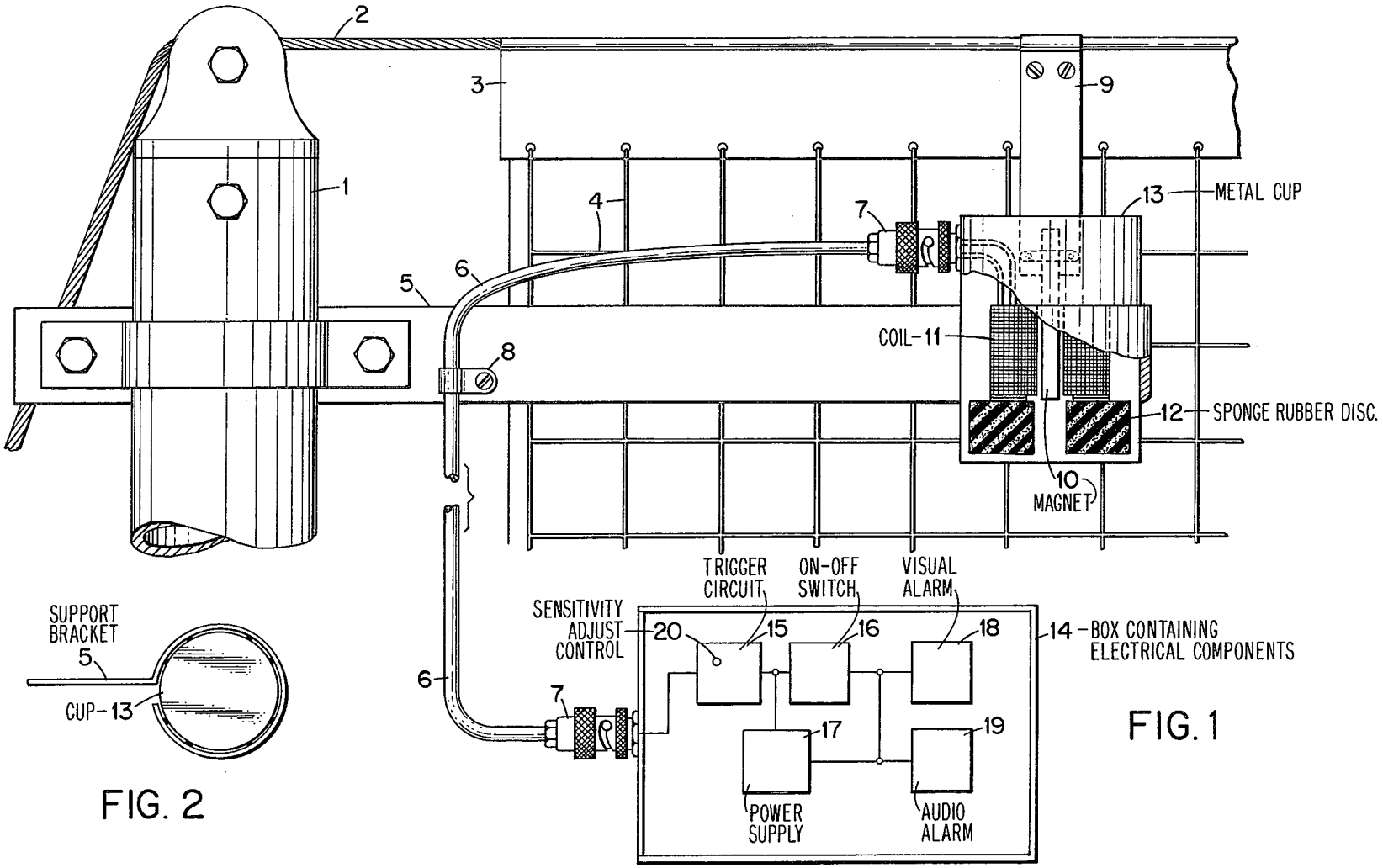
FIG. 1 shows the basic embodiment of the invention
FIG. 2 shows a cross-sectional view of the bracket and cup assembly of FIG. 1.

Referring to FIG. 1, a part 9 made of rigid material such as iron is firmly attached to the net cable 2 or net band 3, which support the net 4; rigidly attached to said part 9 is a permanent magnet 10, positioned so as to extend beyond the support part 9. A support bracket 5 is attached to the net post 1; rigidly attached to this bracket is a metal cup 13, at the bottom of which is cemented a piece of sponge rubber 12 which has the center portion removed, as shown; cemented to the sponge rubber 12 is a coil of electrically-conducting wire 11. The support bracket 5 is positioned so the magnet 10 extends into and near the bottom of the coil 11. The part 9 - magnet 10 assembly must be able to move freely in relation to the coil 11 - sponge rubber 12 - cup 13 assembly. It is important that the support bracket 5 be firmly attached to the net post 1, and the mounting bracket 9 be firmly attached to the net cable 2 or the net band 3. The two terminals of the coil 11 are connected to the input terminals of the trigger circuit 15 by means of the co-axial connectors 7 and the co-axial shielded cable 6. The reason for using a shielded cable is to prevent the turning on of the trigger circuit by spurious electrical phenomena such as lightning or strong broadcast signals. Cable clamp 8 secures the cable to support bracket 5. A box 14 provides protection for the electrical components.

The umpire of the match (or some other designated person such as a linesman) operates the switch 16 so it is off after a proper serve has been made until the play is finished. When a player prepares to serve, the switch 16 is moved to the "ON" position; this switching to the "ON" position causes power from the power-supply 17 to become available at the proper terminals for the correct operation of the apparatus. If the serve that is delivered by the player touches the net so as to produce a vertical motion (or component), the sudden motion of the net cable 2 or the net band 3 causes the magnet 10 to move relative to the coil 11; this motion causes an e.m.f. to appear at the input terminals of the trigger circuit 15. In this disclosure the term 'trigger circuit' is intended to include certain types of amplifier circuits which are able to utilize this kind of input signal so as to deliver sufficient energy to operate the warning devices. This e.m.f. turns on the trigger circuit which activates the audio/-visual output devices 18, 19, giving immediate warning that a let-ball has been served. The amount of motion of the net cable 2 or the net band 3 that is required to turn on the output devices can be adjusted by using the sensitivity control 20. It should be noted that sudden motions of the net cable will generate e.m.f.s many times greater than slow motions of the same amplitude, so a satisfactory level of sensitivity can be obtained without incurring the risk of having the output devices activated by extraneous factors such as winds. The length of time the warning signals are on may be adjusted automatically to, say, one or two seconds' duration, so that if the first serve strikes the net below the top, causing the warning to sound, the trigger would be reset and ready before another serving attempt can be made.

What is claimed is:

1. An apparatus for the detection and immediate warning that a let-ball has occurred in the act of serving a tennis ball; this apparatus comprises a suitable source of electrical energy, so connected as to provide energy to appropriate parts of the apparatus, a coil of electrically-conducting wire which is rigidly attached to a net post or the ground, a magnetic field intersecting said coil, said magnetic field being movable in response to the tennis ball hitting a net cable or net band, an electronic trigger circuit connected to the output of said coil and being responsive to the sensing of said magnetic field movement by said coil, and an output device connected to said trigger circuit in such a manner that when the trigger circuit is turned on, the audio and/or visual evidence is perceivable by human senses.

2. An apparatus as described in claim 1, wherein the member which provides the magnetic field is rigidly attached to the net post or to the ground, and the electrically-conducting coil of wire, which intersects the magnetic field, is rigidly attached to the net cable or net band.

3. An apparatus as described in claim 1, wherein the trigger circuit comprises an amplifier circuit means.

4. An apparatus as described in claim 2, wherein the trigger circuit comprises an amplifier circuit means.

* * * * *